US005544551A

United States Patent [19]

Marcorin et al.

[11] Patent Number: 5,544,551

[45] Date of Patent: Aug. 13, 1996

[54] DEVICE TO DRAW MUSHROOM-SHAPED CORKS

[75] Inventors: Franco Marcorin, Cinto Caomaggiore; Ivo S. Tonel, Pordenone; Dino Munini, S. Quirino, all of Italy

[73] Assignee: Microstamp SrL, S. Quirino, Italy

[21] Appl. No.: 370,206

[22] Filed: Jan. 9, 1995

[30] Foreign Application Priority Data

Jan. 20, 1994 [IT] Italy ..... UD94A0008

[51] Int. Cl.[6] ..... B67B 7/18

[52] U.S. Cl. ..... 81/3.29; 81/3.45

[58] Field of Search ..... 81/3.29, 3.35, 81/3.36, 3.37, 3.45, 3.55

[56] References Cited

U.S. PATENT DOCUMENTS

| | | | |
|---|---|---|---|
| 2,761,338 | 9/1956 | Hardy | 81/3.29 |
| 4,606,245 | 8/1986 | Veverka et al. . | |

FOREIGN PATENT DOCUMENTS

| | | |
|---|---|---|
| 276091 | 1/1988 | European Pat. Off. . |
| 2644647 | 10/1976 | Germany . |
| WO87/00824 | 7/1986 | WIPO . |

*Primary Examiner*—James G. Smith
*Attorney, Agent, or Firm*—Antonelli, Terry, Stout & Kraus

[57] ABSTRACT

Device to draw mushroom-shaped corks (11), which can be gripped and operated by hand and is suitable to draw mushroom-shaped corks (11) consisting of cork or a plastic from bottles of sparkling wine, such sparkling wine bottles being possibly of a type with a neck (12*a*) containing a protruding ledge (22) or with a neck (12*b*) suitable for crown corks, the device comprising an outer shell (13) including in its lower portion a supporting ring (14) solidly fixed longitudinally to, and free to rotate circumferentially in relation to, the outer shell (13), an extractor element (16) being secured circumferentially to the supporting ring (14) and being able to move axially between a first lower end-of-travel position (16*a*) and a second upper end-of-travel position (16*b*), the supporting ring (14) including in its lower portion supporting elements (21) which cooperate with the protruding ledge (22) on the neck (12) of the bottle, the extractor element (16) comprising in its lower portion anchorage and clamping arm means (19) which are equipped at their lower inner ends with claw means (20), which cooperate with the base of the upper head (111) of the mushroom-shaped cork (11), and are equipped at their lower outer ends with elements (24) having an inclined surface and cooperating with abutment elements (25) included on the inner surface of the supporting ring (14).

8 Claims, 3 Drawing Sheets

DEVICE TO DRAW MUSHROOM-SHAPED CORKS

BACKGROUND OF THE INVENTION

This invention concerns a device to draw mushroom-shaped corks.

The device to draw mushroom-shaped corks according to the invention is employed to uncork bottles, which are advantageously bottles containing sparkling wine, such as champagne or other sparkling wines, the bottles being closed with a cork formed as a mushroom.

The device to draw mushroom-shaped corks is able to draw such corks made of cork or of a plastic from bottles which may be of a type with a neck containing a protruding ledge or of a type with a neck for crown corks.

Bottles are known which normally contain sparkling wines and are closed with a mushroom-shaped cork consisting of cork or a plastic and generally retained by a suitably intertwined metallic wire to prevent the cork emerging independently.

These mushroom-shaped corks are generally drawn by hand by rotating the cork in its seating and withdrawing it progressively.

These operations are not always easy to carry out inasmuch as in some cases, if the cork is especially tightly sealed, the rotation of the cork requires a great effort and therefore some persons cannot uncork the bottle.

Moreover, the outer shape of the protruding head of the cork, which has substantially the form of a mushroom, does not make possible an easy engagement by the user as his hand slips on the circumferential surface of the mushroom-shaped head.

Furthermore, it often happens during the drawing operations that the cork comes out unexpectedly and independently without the user being able to hold it, thus causing damage to objects and persons along the path of the cork with all the unpleasant consequences involved.

Devices to draw mushroom-shaped corks have been disclosed but have been found to be not very practical and hard to use.

A first type of device disclosed consists of a kind of gripper of a nut-cracker type, the jaws of which are tightened about the head of the cork; the device is rotated by means of its arms, with the bottle held stationary, so as to draw the cork from the mouth of the bottle.

This device enables corks to be drawn even when they are especially tightly sealed, but the corks may prove to be dangerous if they emerge violently and unexpectedly. Another type of disclosed device is shaped as a gripper, in which one end of the jaws includes lateral fork means that are inserted sideways between the lower base of the head of the cork and the mouth of the bottle. In this case the cork is not gripped between the jaws, but the fork means act as a lifting element. To be more exact, the two arms are brought towards each other and a first fork means is rested on the neck of the bottle, while the other fork means is distanced from the first fork means and thus raises the cork.

This device too to draw the cork has been found to be not very practical and does not ensure the drawing of the cork in one single operation.

SUMMARY OF THE INVENTION

The present applicants have designed, tested and embodied this invention so as to overcome the shortcomings of the state of the art and to achieve further advantages.

The purpose of the invention is to provide a device which draws in a sure and controlled manner mushroom-shaped corks from bottles, which are advantageously bottles containing sparkling wines, without problems of the slipping of the device on the cork and without any risks of damage to things or persons positioned in the vicinity of the user during the uncorking operations.

The device to draw mushroom-shaped corks according to the invention consists of an outer shell which is open at its lower end and acts also as a grip for the user.

This outer shell includes in its lower portion a supporting ring, which can rotate about the lengthwise axis of the shell and of which the lower surface is equipped with supporting elements suitable to cooperate with the upper side of the protruding ledge included in the upper end portion of the neck of the bottle.

The outer shell contains an extractor element, which is axially movable but is circumferentially prevented from rotating in relation to the supporting ring and is suitable to be anchored to the base of the head of the cork and between that base and the lip of the mouth of the bottle.

The axial travel of the movable extractor element is defined between at least two end positions within the outer shell. These two end positions correspond to a first lower position at the beginning of the drawing and a second upper position at completion of the drawing.

The lower end part of the movable extractor element includes anchorage and clamping arm means, which comprise claw means solidly fixed to the lower end of those arm means and able to cooperate with the base of the head of the cork.

During the axial ascending movement of the movable extractor element within the outer shell the anchorage and clamping arm means cooperate with the inner surface of the supporting ring and are thrust radially inwards, thus clamping the head of the cork circumferentially.

According to a special form of embodiment the movable extractor element contains a cork-thrusting element, which advantageously can move axially within the movable extractor element and is thrust resiliently towards the cork.

The cork-thrusting element has a first inactive position, in which the resilient means are fully distended, and a second working position, in which the resilient means are at least partly compressed.

When the device to draw mushroom-shaped corks according to the invention has been placed from above on the head of the cork to be drawn, the cork-thrusting element is rested resiliently on the upper surface of the head of the cork and enables the movement of the cork to be cushioned when the cork has been finally drawn.

The cork-thrusting element performs also the main task of correctly positioning the anchorage and clamping arm means axially on the head of the cork.

This cork-thrusting element ensures in particular that the claw means in the lower part of the anchorage and clamping arm means are positioned correctly to cooperate with the base of the head of the cork and thus to prevent the claw means becoming anchored to the lip of the mouth of the bottle.

A further purpose of the cork-thrusting element is to thrust the cork always towards the outside of the device according to the invention when the cork has been drawn from the bottle. In this way the cork cannot become inclined and jammed within the device according to the invention, and the operations of disengaging the cork from the uncorking device are thus facilitated.

In the device that draws mushroom-shaped corks according to the invention the axial movement of the movable extractor element is ensured by screw-threaded means, which convert the rotation of the outer shell into a relative axial movement of the extractor element.

So as to draw the cork, the user grasps the bottle and the supporting ring and rotates the outer shell.

According to another form of embodiment the supporting ring is divided into two parts, namely a first upper part that acts as a grip and a second lower part that has the task of clamping the movable extractor element on the head of the cork.

The first and second parts are clamped together in the longitudinal direction but are free to rotate reciprocally about their own lengthwise axis by a desired angle.

In this case the circumferential clamping of the anchorage and clamping arm means on the head of the cork is achieved by rotating the lower part of the supporting ring by hand while the upper part of the supporting ring is kept stationary by the user; the uncorking operations then proceed as cited above.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

The reference number 10 in the attached figures denotes generally a device to draw mushroom-shaped corks according to the invention.

The device 10 has the purpose of drawing a mushroom-shaped cork 11 inserted into a neck 12 of a bottle.

The bottle may be of a type with a neck 12*a* comprising a protruding ledge or with a neck 12*b* suitable for crown corks.

Figure 2B:
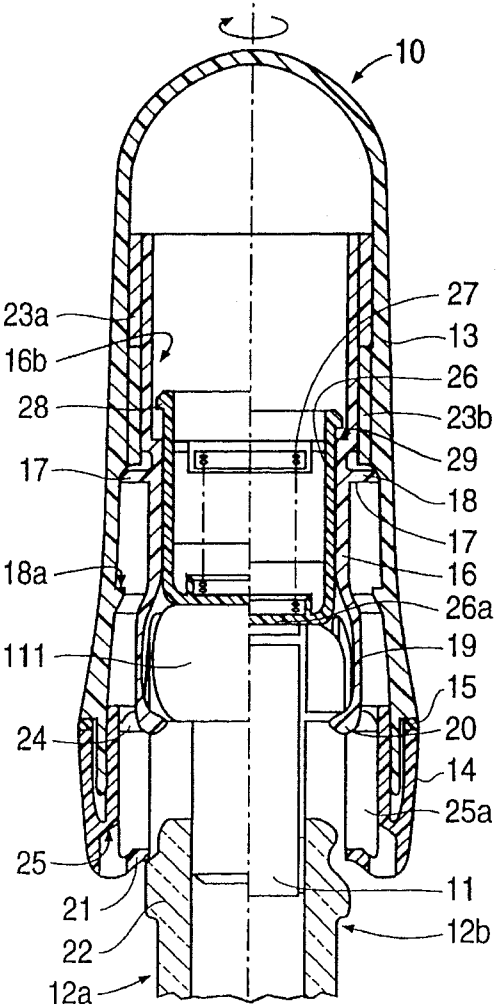
FIG. 2*b* shows a lengthwise section, along the line A—A, of the device of FIG. 1 during the step of substantial completion of drawing of the cork.
Figure 2A:
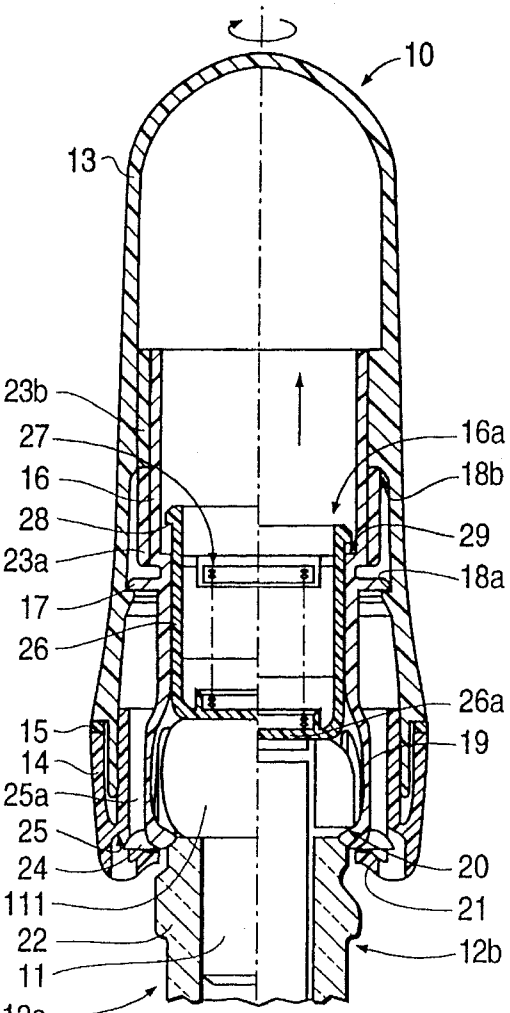
FIG. 2*a* shows a lengthwise section, along the line A—A, of the device of FIG. 1 during the step of positioning the device on the head of a cork fully inserted into the neck of a bottle, one half-section showing a bottle with a cork and a protruding ledge, while the other half-section shows a bottle with a crown cork.
Figure 1:
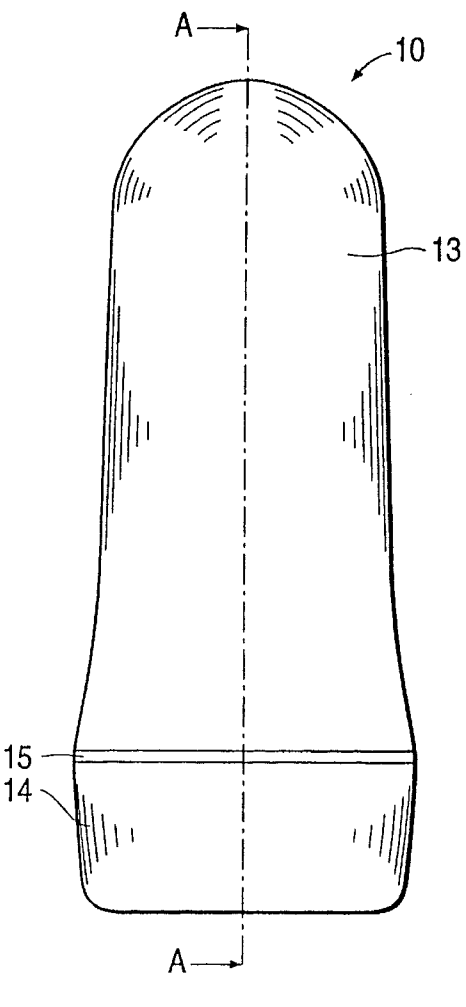
FIG. 1 shows a first form of embodiment of the device to draw mushroom-shaped corks according to the invention.
Figure 6A:
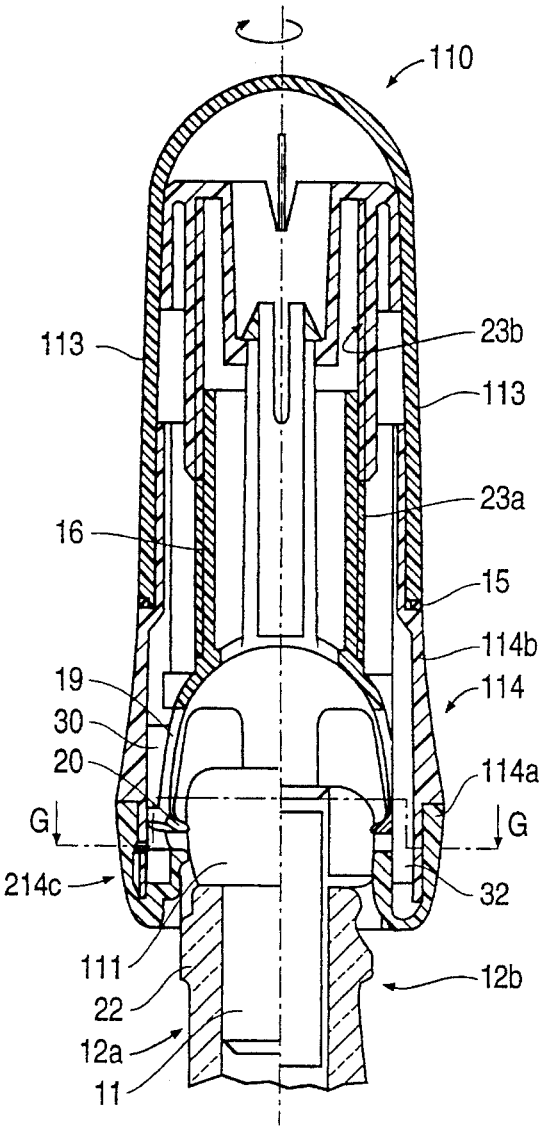
FIG. 6*a* shows a lengthwise section, along the line F—F of FIG. 6*b*, of the device of FIG. 3 during an intermediate phase of positioning the device on the head of the cork.
Figure 3:
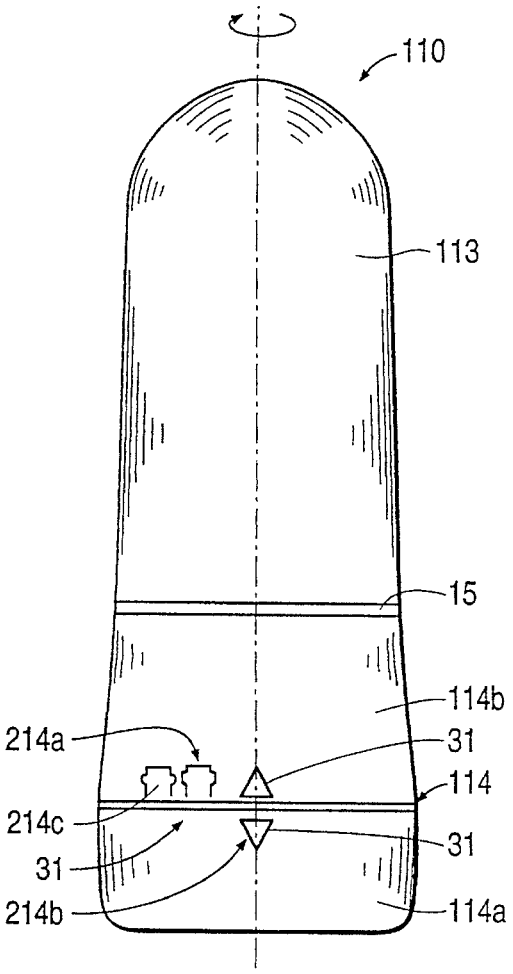
FIG. 3 shows a second form of embodiment of the device to draw mushroom-shaped corks according to the invention.
Figure 6B:
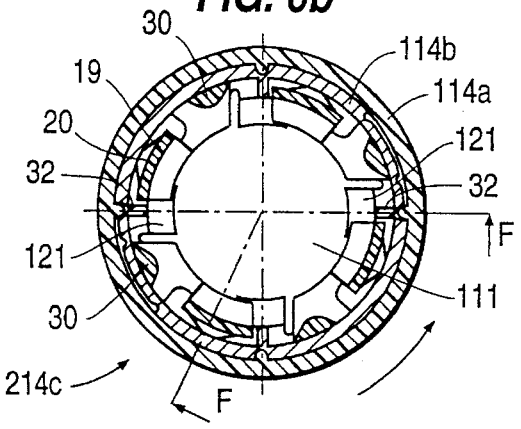
FIG. 6*b* shows a cross-section, along the line G—G of FIG. 6*a*, of the device of FIG. 3 to draw mushroom-shaped corks from a bottle with a neck for crown corks.

The drawing device 10 according to the invention in a first form of embodiment shown in FIGS. 1 and 2*a* and 2*b* comprises a substantially cylindrical outer shell 13.

The outer shell 13 cooperates at its lower end with a supporting ring 14 clamped axially to the outer shell 13 but free to rotate in relation to the outer shell 13.

Antifriction ring means 15 are included in this case and are positioned between the outer shell 13 and the supporting ring 14.

An axially movable extractor element 16 is contained in the outer shell 13 and has a first lower end-of-travel position 16*a* and a second upper end-of-travel position 16*b*; these end-of-travel positions 16*a*–16*b* are determined by the cooperation of a protrusion 17 located on the outer periphery of the extractor element 16 with respective lower 18*a* and upper 18*b* undercuts in the inner surface of the outer shell 13.

The extractor element 16 comprises in its lower portion a plurality of anchorage and clamping arms 19 arranged on its circumference and able to be displaced resiliently in a radial direction. These anchorage and clamping arms 19 cooperate with the circumferential surface of the head 111 of the cork 11 and include inwardly facing claws 20 in cooperation with their lower end. These claws 20 cooperate with the base of the head 111 of the cork 11.

Next, the anchorage and clamping arms 19 include inclined surface means 24 corresponding with the claw 20 but facing outwards.

During the axial movement of the extractor element 16 within the outer shell 13 the inclined surface means 24 cooperate with abutments 25, seperated by walls 25*a*, located in a coordinated position at an intermediate height within the supporting ring 14. This cooperation not only prevents rotation of the extractor element 16 in relation to the supporting ring 14 but also causes an inward radial thrust of the claws 20, which are thus positioned at the base of the head 111 of the cork 11 and clamp the head 111 circumferentially.

The axial movement of the extractor element 16 within the outer shell 13 is ensured in this case by screw-threaded means comprising an outer screw thread 23*a* on the extractor element 16; this outer screw thread 23*a* cooperates with a mating inner screw thread 23*b* on the inner surface of the outer shell 13.

It is thus enough to rotate the outer shell 13 clockwise or anti-clockwise while keeping the bottle and the supporting ring 14 stationary so as to cause a relative axial movement of descent or ascent of the extractor element 16 in relation to the outer shell 13.

The supporting ring 14 comprises at its lower end suitably shaped supporting elements 21 which during the uncorking step, as will be made clear hereinafter, rest on the upper surface of the protruding ledge 22.

In this case a cork-thrusting element 26 is included within the extractor element 16 and cooperates at its lower end with the head 111 of the cork 11 while an upper end of the horizontal plate portion 26*a* thereof cooperates with a resilient spring 27. The cork-thrusting element 26 can move axially within the extractor element 16 and has a first lowered inactive position defined by cooperation of a circumferential projection 28 with an abutment face 29.

The uncorking operations performed by the device 10 that draws mushroom-shaped corks 11 according to the invention are carried out by a user by hand and include the following steps:

passing the device 10 that draws mushroom-shaped corks 11 from above onto the neck 12 of a bottle until the anchorage and clamping arms 19 are positioned in cooperation with the head 111 of the cork 11;

the user then grasps the bottle and the supporting ring 14 and rotates the outer shell 13, thus causing the progressive lowering of the drawing device 10 until the supporting elements 21 of the supporting ring 14 are in contact with the protruding ledge 22 of the neck 12 of the bottle, with simultaneous clamping of the head 111 of the cork 11 by the anchorage and and clamping arms 19 when the inclined surface means 24 cooperate with the abutments 25;

further rotation of the outer shell 13 now causes re-ascent of the extractor element 16 within the outer shell 13, and the extractor element 16 draws the cork 11 with it in its movement of re-ascent.

The cork 11 is fully or substantially fully drawn from the bottle at the end of rotation of the outer shell 13.

According to another form of embodiment shown in FIGS. 3 to 6 the device 110 to draw mushroom-shaped corks 11 according to the invention comprises an outer shell 113 cooperating with a supporting ring 114 consisting of two parts, namely a lower part 114*a* and an upper part 114*b* respectively. The upper part 114*b* acts as a grip, while the lower part 114*a* is associated at its lower end with the neck 12 of the bottle.

The lower 114*a* and upper 114*b* parts are clamped together longitudinally but are capable of reciprocal rotation about their lengthwise axis.

In this case the lower part 114*a* of the supporting ring 114 contains a plurality of clamping wedges 30 in a number and in positions coordinated with the anchorage and clamping arms 19 comprised on the extractor element 16.

Figure 4B:
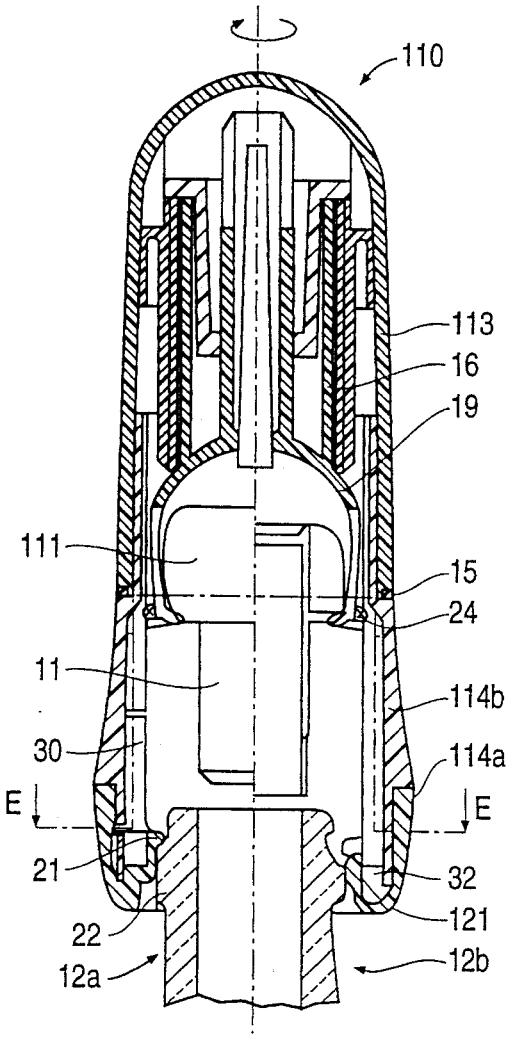
FIG. 4*b* shows a lengthwise section, along the line C—C of FIG. 5*b*, of the device of FIG. 3 with the cork fully drawn out.
Figure 4A:
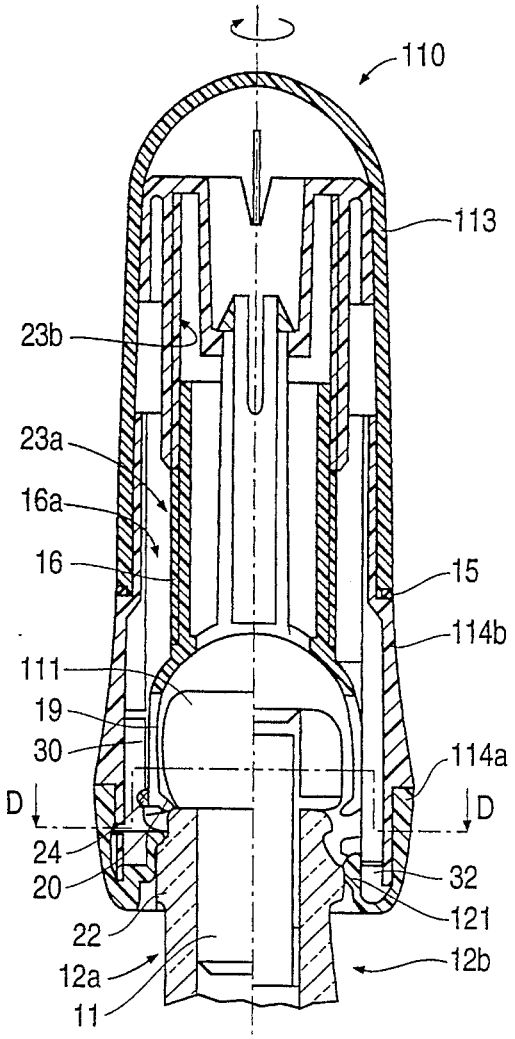
FIG. 4*a* shows a lengthwise section, along the line B—B of FIG. 5*a*, of the device of FIG. 3 positioned in cooperation with the head of the cork to be drawn, one half-section showing a bottle with a cork and protruding ledge, while the other half-section shows a bottle with a crown cork.
Figure 5B:
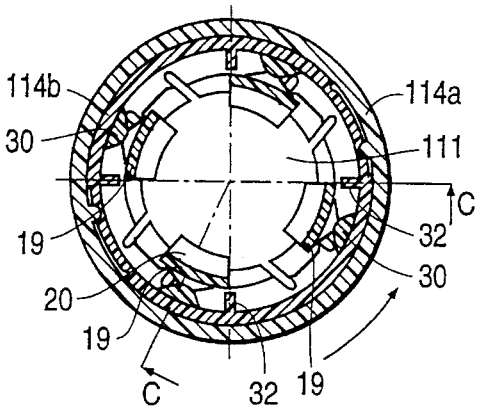
FIG. 5*b* shows a cross-section, along the line E—E of FIG. 4*b*, of the device of FIG. 3 to draw mushroom-shaped corks.
Figure 5A:
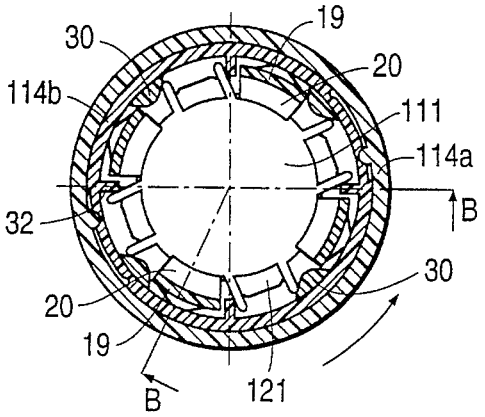
FIG. 5*a* shows a cross-section, along the line D—D of FIG. 4*b*, of the device of FIG. 3 to draw mushroom-shaped corks.

The lower part 114*a* of the supporting ring 114 has a first angular insertion position 214*a*, in which the anchorage and clamping arms 19 are free to expand resiliently outwards so as to adapt themselves to the variable diameter of the head 111 of the cork 11 (FIGS. 4*a* and 5*a*), and also has a second angular clamping position 214*b*, in which the clamping wedges 30 cooperate at their rear with the respective anchorage and clamping arms 19, which thus secure the claws 20 to the base of the head 111 of the cork 11 so as to ensure correct drawing of the cork 11 (FIGS. 4*b* and 5*b*).

These respective angular positions of insertion 214*a* and clamping and drawing 214*b* are indicated advantageously with reference notches 31 on the outer surface of the drawing device 110 for mushroom-shaped corks 11 above and below the line separating the lower 114*a* and upper 114*b* parts of the supporting ring 114.

When the lower part 114*a* of the supporting ring 114 has been brought to the second angular clamping position 214*b*, the drawing operations proceed as described above, by blocking rotation of the supporting ring 114 and by rotating the outer shell 113.

According to a variant, for correct positioning of the drawing device 110 for mushroom-shaped corks 11 according to the invention on bottles having a neck 21*b* suitable for crown corks (see the righthand part of the FIGS. 4*a*, 4*b* and 6*a*), the supporting ring 114 may include auxiliary supporting elements 121 of a resilient type.

These auxiliary supporting elements 121 of a resilient type are placed in a position below the supporting elements 21 and cooperate with the protruding ledge 22 of the neck 12*b* of the bottle so as to position the cork drawing device 110 correctly on the head 111 of the cork 11.

According to a further variant the lower part 114*a* of the supporting ring 114 contains a plurality of ribs 32 arranged in a number and in positions coordinated with the auxiliary supporting elements 121 of a resilient type. These ribs 32 are caused to cooperate with the auxiliary supporting elements 121 of a resilient type by clamping them radially in a third angular position 214*c* (FIGS. 6*a*–6*b*), which corresponds to the positioning of the drawing device 110 for mushroom-shaped corks 11 according to the invention on the head 111 of the cork 11 of a bottle having a neck 12*b* suitable for a crown cork.

This third angular position 214*c* too is indicated advantageously with the reference notches 31 on the outer surface of the device 110 that draws mushroom-shaped corks 11.

We claim:

1. Device to draw mushroom-shaped corks, which can be gripped and operated by hand and is suitable to draw mushroom-shaped corks consisting of cork or a plastic from bottles of sparkling wine, comprising:

an outer shell;

a supporting ring solidly fixed longitudinally to a lower portion of the outer shell, and free to rotate circumferentially in relation to the outer shell;

an extractor element secured to the outer shell and being able to move axially between a first lower end-of-travel position and a second upper end-of-travel position but circumferentially prevented from rotating;

supporting elements provided at a lower portion of the supporting ring able to cooperate with a protruding ledge on a neck of 74*a* bottle; and anchorage and clamping arms provided on the extractor element, the anchorage and clamping arms being equipped at their lower inner ends with claws which cooperate with a base of an upper head of the mushroom-shaped cork, and are equipped at their lower outer ends with elements having an inclined surface and cooperating with abutment elements included on the inner surface of the supporting ring, whereby axial ascending movement of the extractor element causes the anchorage and clamping arms to be thrust radially inward to clamp the cork.

2. Device to draw mushroom-shaped corks as in claim 1, further comprising an outer screw thread cooperating with an inner mating screw thread on the inner surface of the outer shell for for translating rotational movement of the outer shell to axial movement of the extractor element.

3. Device to draw mushroom-shaped corks as in claim 1, in which the extractor element contains a cork-thrusting element able to move axially and cooperating with resilient pressure means.

4. Device to draw mushroom-shaped corks as in claim 1, in which an antifriction ring is included between the outer shell and the supporting ring.

5. Device to draw mushroom-shaped corks as in claim 1, in which respective lower and upper end-of-travel positions of the extractor element are determined by cooperation of a protrusion included peripherally on the outside of the extractor element with respective lower and upper undercuts included in the circumference of the inner surface of the outer shell.

6. Device to draw mushroom-shaped corks as in claim 1, wherein the supporting ring comprises a first lower portion and a second upper portion which are constrained axially but can move circumferentially by a certain angle, the first lower portion of the supporting ring containing a plurality of clamping wedges arranged in a number and in positions coordinated with the anchorage and clamping arms, the first lower portion of the supporting ring having at least a first angular position of insertion of the device, in which the clamping wedges are free of anchorage and clamping arms, and a second angular drawing position, in which the clamping wedges cooperate with the anchorage and clamping arms.

7. Device to draw mushroom-shaped corks as in claim 6, in which the first lower portion of the supporting ring comprises at its lower end auxiliary resilient supporting elements which, in a third angular position of the first lower portion of the supporting ring, cooperate with coordinated ribs during the step of positioning the device on bottles having a neck suitable for a crown corks.

8. Device to draw mushroom-shaped corks as in claim 6, which includes reference notches above and below a line of separation between the upper portion and lower portion of the supporting ring, these reference notches indicating the different angular positions of the lower portion of the supporting ring.

* * * * *